United States Patent [19]

Ichikawa

[11] 4,309,867

[45] Jan. 12, 1982

[54] YARN COVERING APPARATUS

[75] Inventor: Michihiro Ichikawa, Kiryu, Japan

[73] Assignees: Katsuzo Ichikawa; Yumiko Hori, both of Kiryu, Japan

[21] Appl. No.: 112,316

[22] Filed: Jan. 15, 1980

[30] Foreign Application Priority Data

Nov. 30, 1979 [JP] Japan ..... 54-155074

[51] Int. Cl.[3] ..... D02G 3/36; D02G 3/38

[52] U.S. Cl. ..... 57/58.3; 57/3

[58] Field of Search ..... 57/58.3–58.38, 57/3, 6, 16, 18

[56] References Cited

U.S. PATENT DOCUMENTS

| | | | |
|---|---|---|---|
| 2,729,051 | 1/1956 | Clarkson | 57/58.3 |
| 2,732,680 | 1/1956 | Vibber | 57/58.3 |
| 2,737,773 | 3/1956 | Clarkson | 57/3 |
| 2,811,012 | 10/1957 | Klein | 57/58.36 X |
| 2,857,730 | 10/1958 | Vibber | 57/58.3 |
| 3,307,342 | 3/1967 | Vibber | 57/58.3 |
| 3,820,316 | 6/1974 | Clarkson | 57/58.3 X |

*Primary Examiner*—John Petrakes

*Attorney, Agent, or Firm*—Armstrong, Nikaido, Marmelstein & Kubovcik

[57] ABSTRACT

A yarn covering apparatus in which a covering yarn is supplied from a supply package positioned externally of a core yarn supply assembly including a rotor unit adapted to have the covering yarn passed therethrough, a member rotatable about the axis of rotation of the rotor unit and held stationary by means of permanent magnets, and a core yarn delivery mechanism mounted on the member and driven for rotation independently of the rotation of the rotor unit whereby the covering yarn supplied from the aforesaid supply package and continuously turned about the axis of rotation of the rotor unit is entwined around a core yarn supplied from a supply package carried by the core yarn delivery mechanism.

63 Claims, 9 Drawing Figures

YARN COVERING APPARATUS

FIELD OF THE INVENTION

The present invention relates to a yarn covering apparatus for the production of a covered thread composed of a core yarn and a covering yarn entwined around the core yarn.

BACKGROUND OF THE INVENTION

In a known yarn covering apparatus, a core yarn continuously supplied from a yarn package is passed through a covering yarn supply unit positioned between the core yarn package and a take-up unit and is combined with a covering yarn through an aperture in an eyelet element located between the covering yarn supply unit and the take-up unit. The covering yarn supply unit has a covering yarn package provided therein and is driven for continuous rotation about an axis aligned with the aperture in the eyelet element so that the covering yarn supplied from the yarn supply unit is caused to turn about the axis of rotation of the yarn supply unit and entwine around the core yarn being coveyed past the eyelet element.

A problem is encountered in a prior-art yarn covering apparatus of this nature in that the quantity of the covering yarn which can be stored in and supplied from the covering yarn supply unit is limited by the size of the supply unit while there is practically no limit to the quantity of the core yarn to be supplied from the core yarn supply package provided externally of the core yarn supply unit.

An object of the present invention is to provide an improved yarn covering apparatus which is free from such a problem.

SUMMARY OF THE INVENTION

In accordance with the present invention, there is provided a yarn covering apparatus which comprises a rotor having a said center axis and formed with a passageway which is adapted to have a covering yarn passed therethrough and which is open at the outer end of the rotatable member, first and second members spaced apart from each other across the rotatable member, the first stationary member being held stationary with respect to the center axis of the rotor unit and the second member being rotatable about the center axis of the rotor unit with respect to the rotor unit, positioning means arranged across the rotatable member and operative to urge the second member to stay in a predetermined angular position about the center axis of the rotor unit with respect to the first member, a core yarn delivery mechanism supported on the second member and including a rotatable member having a center axis therethrough and rotatable about the center axis thereof with respect to the second member, first drive means operative to drive the rotor unit for rotation about the center axis thereof, and second drive means arranged across the rotatable member of the rotor unit and operative to drive the rotatable member of the core yarn delivery mechanism for rotation about the center axis thereof.

The positioning means may comprise two permanent magnets which are supported by the first and second members, respectively, and which are substantially aligned with each other across the rotatable member of the rotor unit when the second member is held in the above mentioned predetermined angular position with respect to the first member.

On the other hand, the second drive means may comprise two substantially circular permanent magnets which are supported by said first and second members, respectively, and which have respective center axes substantially aligned with each other across the rotatable member of the rotor unit when the second member is held in the aforesaid predetermined angular position with respect to the first member, the permanent magnets of the second drive means being rotatable about the respective center axes thereof with respect to the first and second members, respectively, the permanent magnet forming part of the second drive means and supported by the second member being connected to and rotatable with the rotatable member of the core yarn delivery mechanism.

The rotor unit may comprise a spindle secured to the rotatable member of the rotor unit and having a center axis substantially coincident with the center axis of the rotor unit, the first and second members being rotatable on the spindle about the center axis of the spindle. In this instance, a yarn covering apparatus according to the present invention may further comprise a movable support member which is pivotally movable about a fixed pivotal axis substantially parallel with the center axis of the spindle and which has securely supported thereon the first member so that the rotor unit and the first and second members are pivotally movable together about the aforesaid fixed pivotal axis. Furthermore, the first drive means may comprise an endless drive belt in part extending in a direction substantially perpendicular in non-intersecting relationship to the center axis of the spindle and in which the spindle is engageable with the drive belt for being driven to rotate about the center axis thereof when the drive belt is driven to travel. In this instance, the rotor unit may be arranged in such a manner as to be pivotally movable with the movable support member about the above mentioned fixed pivotal axis into and out of a predetermined angular position having the spindle contacted by the endless drive belt and, likewise, the movable support member may be arranged in such a manner as to be pivotally movable about the fixed pivotal axis into and out of a predetermined angular position. The permanent magnet forming part of the second drive means and supported by the first member may be a movable permanent magnet axially movable between the first member and the rotatable member of the rotor unit into and out of a predetermined axial position closest to the permanent magnet forming part of the second drive means and supported by the second member and the permanent magnet forming part of the second drive means and supported by the second member is secured to the second member, each of the two permanent magnets having opposite magnetic poles which are arranged alternately to each other along the outer circumference of the magnet. In this instance, the yarn covering apparatus according to the present invention may further comprise an emergency stop mechanism operatively engaging the rotor unit and responsive to the movement of the aforesaid axially movable permanent magnet away from the predetermined axial position thereof for being operative to cause the rotor unit to cease rotation about the center axis thereof when the axially movable permanent magnet is axially moved away from the other permanent magnet of the positioning means. The emergency stop mechanism thus arranged may comprise lever means engageable with the movable support member and having a first condition allowing the movable support member to stay in the predetermined angular position thereof and a second condition allowing the movable support member to turn out of the predetermined angular position thereof, the positioning means being disconnected from the lever means for allowing the lever means to maintain the first condition thereof when the axially movable permanent magnet supported by the first member is held in the predetermined axial position thereof and being operative to actuate the lever means into the second condition thereof when the movable permanent magnet is moved out of the predetermined axial position thereof. In the yarn covering apparatus thus constructed, the aforesaid positioning means may comprise restraining means for restraining the above mentioned axially movable permanent magnet from pivotal movement about the center axis thereof with respect to the first member when the movable permanent magnet is held in the predetermined axial position thereof.

BRIEF DESCRIPTION OF THE DRAWINGS

The background of the present invention over prior art and the features and advantages of a yarn covering apparatus according to the present invention will be more clearly understood from the following description taken in conjunction with the accompanying drawings, in which.

FURTHER DESCRIPTION OF THE PRIOR ART

Figure 1:
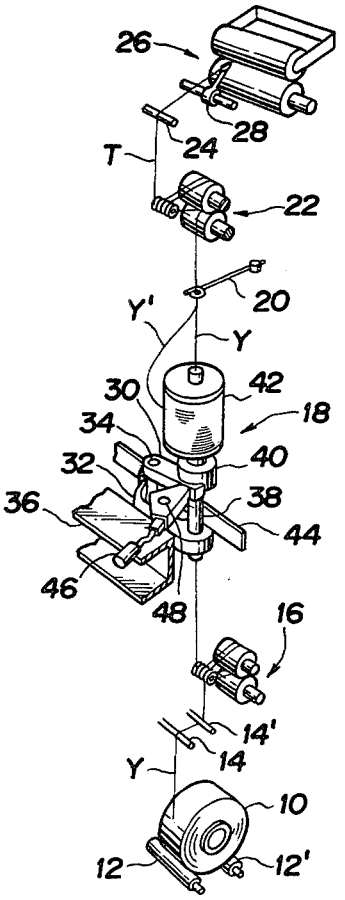
FIG. 1 PRIOR ART
FIG. 1 is a perspective view schematically showing the general arrangement of a prior-art yarn covering apparatus.

In a conventional yarn covering apparatus illustrated in FIG. 1 of the drawings, a core yarn Y is continuously unwound from a suitable yarn package such as a yarn roll 10 positioned and rotatable on driven rollers 12 and 12' and is upwardly passed via stationary guide bars 14 and 14' and a tension roller arrangement 16 to a covering yarn supply unit 18. The core yarn Y passed through the covering yarn supply unit 18 is combined with a covering yarn Y' which is continuously supplied from the covering yarn supply unit 18 and which is entwined around the core yarn Y at an eyelet element 20 positioned above the covering yarn supply unit 18. A covered thread T consisting of the core yarn Y and the covering yarn Y' entwined around the core yarn Y is thus formed past the aperture in the eyelet element 20 and is upwardly conveyed by way of a tension roller arrangement 22 and a stationary guide bar 24 for being wound into roll form by means of a take-up roller unit 26 positioned above the tension roller arrangement 22 and including a traverse mechanism 28 as shown.

The covering yarn supply unit 18 comprises a movable bracket 30 pivotally mounted on a stationary bracket 32 by means of a pivot pin 34 having a vertical center axis. The stationary bracket 32 in turn is fixedly secured to a stationary frame structure which is in part indicated at 36. The movable bracket 30 has a pair of arm portions which are vertically spaced apart from each other and which have supported thereon a hollow vertical spindle 38 by suitable bearings 40 and 40' which are mounted on the arm portions, respectively, of the bracket 30. The hollow vertical spindle 38 is thus rotatable about its center axis with respect to the movable bracket 30 and is adapted to support a covering yarn supply bobbin 42 on its upper portion projecting upwardly from the upper bearing 40 as shown. The movable bracket 30 is angularly movable about the vertical center axis of the pivot pin 34 into and out of a predetermined operative position to be contacted by an endless drive belt 44 and is urged to move out of the operative position by suitable biasing means (not shown). The movable bracket 30 is moved into the operative position thereof against the force of the biasing means by manipulating a handle 46 which is mounted on the frame structure 36 by means of a pivot pin 48 and which is pivotally movable into and out of an angular position holding the bracket 30 in the operative position thereof. Though not shown in the drawings, the endless drive belt 44 forms part of a belt and pulley arrangement to be driven by a suitable drive unit so that the spindle 38 is driven for rotation about the vertical center axis thereof when the movable bracket 30 is held in the above mentioned operative position thereof and the drive unit is in operation.

The hollow vertical spindle 38 has an axial bore extending throughout the length of the spindle 38 and open at the upper and lower ends of the spindle 38. The core yarn Y which is upwardly moved past the tension roller arrangement 16 positioned below the covering yarn supply unit 18 is passed to the eyelet element 20 through the axial bore in the spindle 38.

The core yarns which are used for the projection of covered threads are relatively fine yarns usually having 20 to 40 denier numbers. On the other hand, the covering yarns for use with such core yarns are relatively thick yarns usually having 70 to 300 denier numbers or are used in the form of bundles of tens of relatively fine yarns. Because, furthermore, of the fact that a covering yarn is helically coiled on a core yarn, the package of the covering yarn to be provided for the production of a covered thread must be of such a capacity that the covering yarn to be supplied from the yarn package is several to tens or even more of times longer than the core yarn to be used, if it is desired that the package of the covering yarn be consumed almost simultaneously when the core yarn is used up during production of a covered thread.

From these points of view, a conventional yarn covering apparatus of the nature hereinbefore described has a functional contradiction in that, while there is practically no limit to the quantity of the core yarn to be supplied from a source provided independently of and outside the covering yarn supply unit 18, the quantity of the covering yarn which can be stored in and supplied from the covering yarn supply unit 18 is limited by the size of the yarn supply bobbin 42 and accordingly the size of the yarn supply unit 18 per se. For this reason, the covering yarn supply unit 18 must be frequently resupplied with fresh yarn packages before a core yarn available from the source thereof is used up. This has been an obstacle in improving the production efficiency of a conventional yarn covering apparatus and realizing a fully automated yarn covering apparatus. The goal of the present invention is to provide a solution to these problems which have thus far been inherent in a prior-art yarn covering apparatus of the described general nature.

DESCRIPTION OF THE PREFERRED EMBODIMENT

Figure 2:
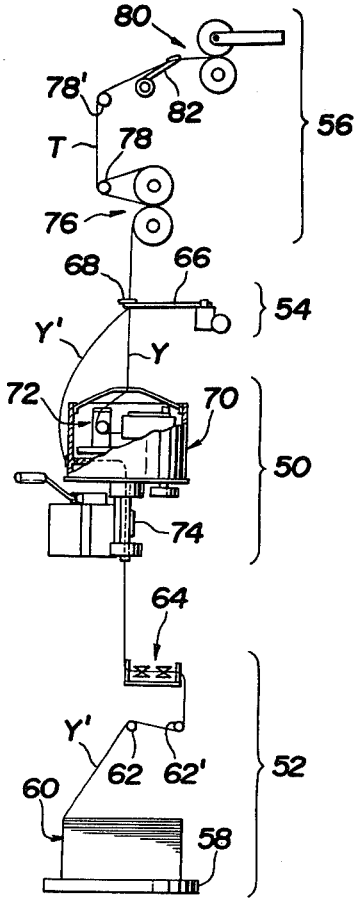
FIG. 2 is a view similar to FIG. 1 but shows the general arrangement of a preferred embodiment of a yarn covering apparatus according to the present invention.

Referring to the drawings, particularly FIG. 2 thereof, a preferred embodiment of an improved yarn covering apparatus according to the present invention largely comprises core yarn supply means 50, covering yarn supply means 52 positioned below the core yarn supply means 50, yarn combining means 54 positioned above the core yarn supply means 50, and covered-thread take-up means 56 positioned above the yarn combining means 54. The covering yarn supply means 52 comprises a yarn package support member 58 positioned below the core yarn supply means 50 and adapted to have supported thereon a suitable yarn package 60 of a covering yarn Y′ which is shown packed in roll form. During operation of the yarn covering apparatus, the covering yarn Y′ is continuously unwound from the yarn package 60 and is passed to the core yarn supply means 50 by way of stationary guide bars 62 and 62′ horizontally extending above the yarn package 60 and a tension roller unit 64 positioned between the core yarn supply means 50 and the guide bars 62 and 62′.

The covering yarn Y′ thus conveyed upwardly to the core yarn supply means 50 is passed therethrough and is fed to the yarn combining means 54 which comprises an eyelet element 66 formed with an aperture 68 which is open vertically above the core yarn supply means 50. The core yarn supply means 50 comprises a rotor unit 70 which is rotatable about a vertical axis substantially alinged with the paths of the covering yarn Y′ between the tension roller unit 64 and the core yarn supply means 50 and between the core yarn supply means 50 and the aperture 68 in the eyelet element 66. The rotor unit 70 has mounted therein a core yarn delivery mechanism 72 and is engageable with a horizontally travelling endless drive belt 74 forming part of a main belt and pulley arrangement in the yarn covering apparatus embodying the present invention and adapted to be driven by suitable drive means (not shown). The core yarn Y leading from the core yarn delivery mechanism 72 positioned within the rotor unit 70 is upwardly passed through the aperture 68 in the eyelet element 66 so that, when the rotor unit 70 of the core yarn supply means 50 is being driven for rotation about the vertical center axis thereof, the covering yarn Y′ passed through the rotor unit 70 in a manner to be described in detail is entwined at the aperture 68 in the eyelet element 66 around the core yarn Y which is passed from the rotor unit 70 to the eyelet element 66 in a manner which is also to be described in detail, thereby forming a covered thread. The covered thread T thus formed by the core and covering yarns Y and Y′ is upwardly conveyed past the aperture 68 in the eyelet element 66 and is passed to the take-up means 56 which is shown comprising a tension roller unit 76 positioned above the eyelet element 66, stationary guide bars 78 and 78′ horizontally extending adjacent the tension roller unit 76 and a take-up unit 80 including a traverse mechanism 82.

Description will be hereinafter made regarding the detailed construction and arrangement of the core yarn supply means 50 included in the yarn covering apparatus which is constructed and arranged generally as above described.

Figure 3:
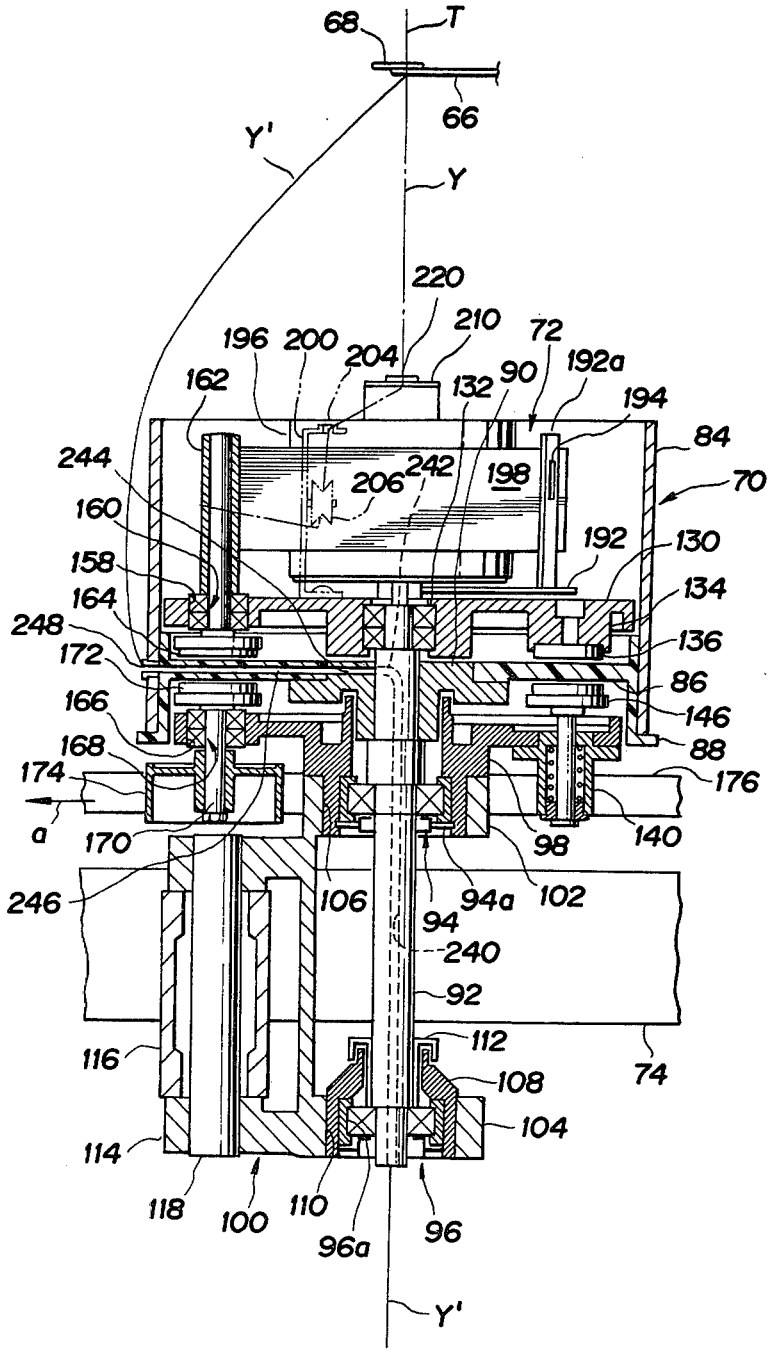
FIG. 3 is a vertical sectional view showing the detailed construction of a core yarn supply unit forming part of the embodiment illustrated in FIG. 2.
Figure 4:
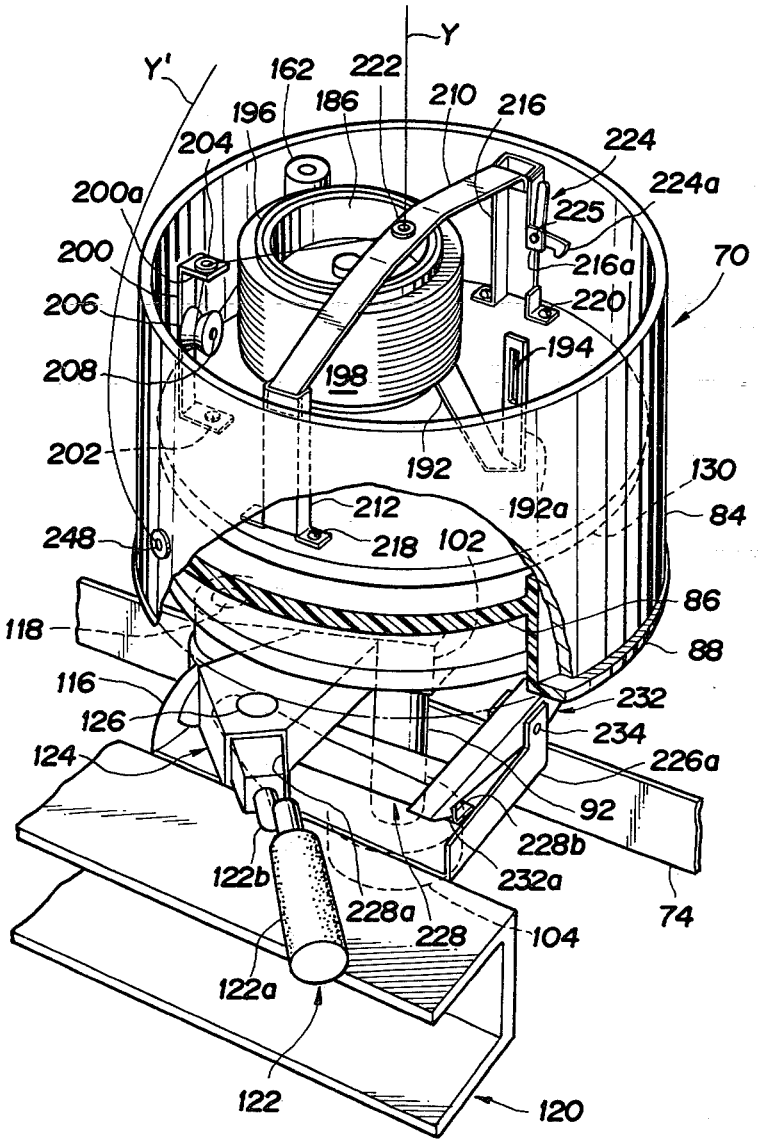
FIG. 4 is a partially cut-away perspective view of the core yarn supply unit shown in FIG. 3.

Referring to FIGS. 3 and 4 of the drawings, the rotor unit 70 forming part of the core yarn supply means 50 comprises a hollow rotor cylinder 84 having a vertical center axis and an annular bottom disc 86 having at its lower end an annular flange portion 88 secured to the rotor cylinder 84 along the lower edge of the cylinder 84. The cylindrical rotor cylinder 84 is open upwardly below the eyelet element 66 forming part of the yarn combining means 54 shown in FIG. 2 and is positioned in such a manner that the vertical center axis thereof is substantially aligned with the aperture 68 in the eyelet element 66 as will be seen from FIG. 2. The bottom disc member 86 is further secured along its inner peripheral edge to a generally disc-shaped hub 90 having a central sleeve portion which is formed with an axial bore having a vertical center axis substantially coincident with the vertical center axis of the cylindrical rotor cylinder 84. For the reason that will be understood as the description proceeds, it is important that the bottom disc member 86 of the rotor unit 70 be constructed of a non-magnetic material such as for example Bakelite or the like. A spindle 92 is secured to the hub 90 through the axial bore in the hub and axially extends downwardly from the hub 90.

As will be better seen from FIG. 3, the spindle 92 thus extending downwardly from the hub 90 is journaled in upper and lower bearing units 94 and 96. The upper bearing unit 94 comprises a series of balls rollable between an inner race member forced on to an upper journal portion of the spindle 92 and an outer race member **94*a* carried in a central sleeve portion of a lower disc member 98 which is positioned immediately below the hub 90 and the annular bottom disc member 86 of the rotor unit 70. The lower disc member 98 in turn is supported on a movable bracket 100 having upper and lower arm portions 102 and 104 which are vertically spaced apart in parallel from each other as will be better seen from FIG. 5. The upper arm portion 102 of the bracket 100 is formed with a cylindrical opening 106 (FIG. 3) having a vertical center axis. The sleeve portion of the lower disc member 98 is closely fitted into the opening 106 thus formed in the upper arm portion 102 of the movable bracket 100. On the other hand, the lower bearing unit 96 for the spindle 92 comprises a series of balls rollable between an inner race member forced on to a lower journal portion of the spindle 92 and an outer race member 96*a* fixedly held in a bearing retainer casing 108 as illustrated in FIG. 3. The lower arm portion 104 of the above mentioned movable bracket 100 is formed with a cylindrical opening 110 having a vertical center axis substantially aligned with the vertical center axis of the opening 106 in the upper arm portion 102 of the bracket 100 and has the above mentioned bearing retainer casing 108 closely fitted into the opening 110. The bearing retainer casing 108 has a generally frusto-conical upper extension surrounding an axial portion of the spindle immediately above the lower bearing unit 104. A flanged, generally cylindrical dust cover element 112 is fixedly attached to the above mentioned axial portion of the spindle 92 and has a flange portion which is turned back in such a manner as to cover an upper end portion of the frusto-conical extension of the bearing retainer casing 108 so as to prevent an ingress of dust and flue into the bearing unit 96**.

Figure 5:
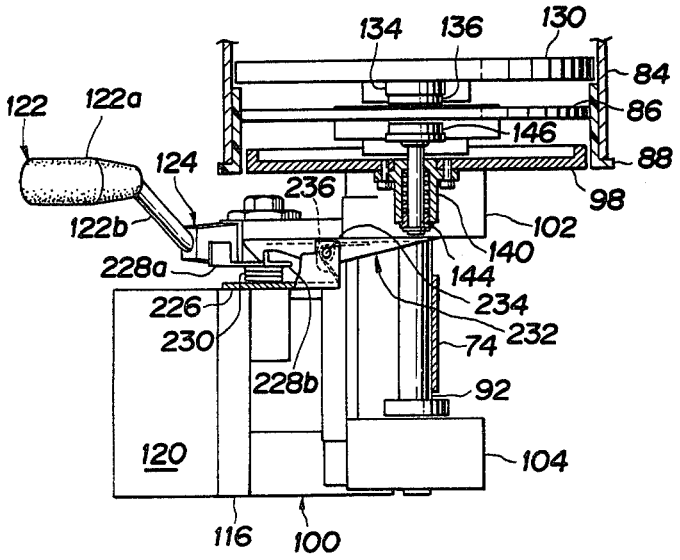
FIG. 5 is a side elevation view, partially in section, of the core yarn supply unit.

The movable bracket 100 further has a base portion 114 from which the upper and lower arm portions 102 and 104 of the bracket 100 extend substantially horizontally as will be seen from FIG. 5. The base portion 114 of the bracket 100 is pivotally connected to a stationary bracket 116 by means of a pivot pin 118 (FIGS. 3 and 4) which is secured to the movable bracket 100 and rotatable in the stationary bracket 116 about a vertical center axis of the pivot pin 118. As will be better seen from FIG. 6 of the drawings, the stationary bracket 116 in turn is fixedly connected and supported by a suitable stationary structural member 120 (also shown in FIG. 4) which may form part of the frame structure of the yarn covering apparatus. The movable bracket 100 is thus angularly movable with respect to the stationary bracket 116 about the vertical center axis of the pivot pin 118 into and out of a predetermined operative position in which the spindle 92 forming part of the rotor unit 50 (FIG. 2) is contacted and pressed upon by the endless drive belt 74 as shown in FIGS. 4 and 5. The movable bracket 100 is urged to turn away from such an angular position by suitable biasing means (not shown). As will be understood from the above description, the lower disc member 98 supported on the upper arm portion 102 of the movable bracket 100 is held stationary with respect to the bracket 100 per se but is angularly movable with the movable bracket 100 about the vertical center axis of the pivot pin 118 with respect to the stationary bracket 116 and accordingly to the stationary structural member 120 of the frame structure.

Figure 6:
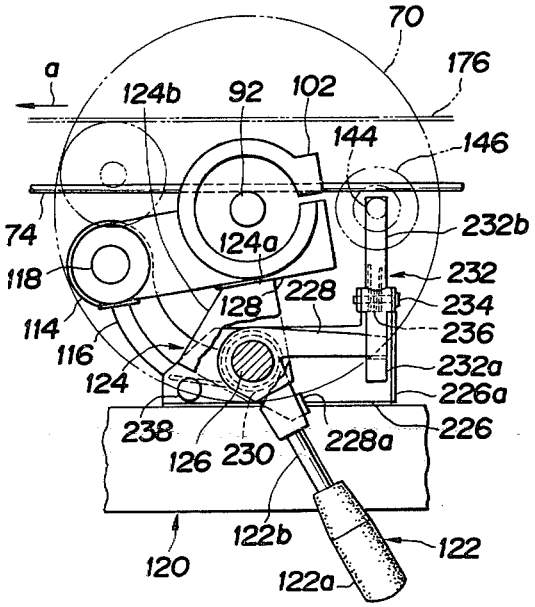
FIG. 6 is a top plan view of the rotor unit and emergency stop mechanism included in the core yarn supply unit.

The movable bracket 100 is manually moved into the above mentioned predetermined angular position thereof by manipulating a handle 122 connected to a cam member 124 as shown in FIGS. 4 to 6. The cam member 124 is pivotally mounted on the stationary bracket 116 by means of a pivot pin 126 having a vertical center axis and is thus rotatable with the handle 122 about the center axis of the pivot pin 126 with respect to the stationary structural member 120 of the frame structure. The upper arm portion 102 of the movable bracket 100 has a flat vertical surface portion 128 facing the cam member 124. The cam member 124 in turn has flat vertical first and second cam surfaces **124*a* and 124*b* which are angled with respect to each other about an edge formed therebetween as will be best seen from FIG. 6. The cam member 124 is thus engageable with the arm portion 102 of the movable bracket 100 by either of the first and second cam surface portions 124*a* and 124*b* thereof depending upon the angular position of the cam member 124 about the center axis of the pivot pin 126. When the cam member 124 is turned into a first angular position about the center axis of the pivot pin 126, the cam member 124 is brought into engagement with the surface portion 128 of the movable bracket 100 by the first cam surface portion 124*a* thereof and forces the movable bracket 100 to turn about the center axis of the pivot pin 118 into the previously mentioned predetermined operative position in which the spindle 92 is pressed upon by the drive belt 74 as shown in FIG. 6. The surface portion 128 of the movable bracket 100 and the first cam surface portion 124*a* of the cam member 124 are held substantially perpendicularly to a plane containing the vertical center axis of the pivot pin 126 for the cam member 124 turned into the first angular position thereof as will be understood from the illustration of FIG. 6. The movable bracket 100 is biased to turn away from the operative position thereof as previously noted but is, for the above described reason, maintained in the operative position thereof unless the cam member 124 once turned into the first angular position thereof is forced to turn in the opposite direction from the first angular position. When the cam member 124 is turned into a second angular position about the center axis of the pivot pin 126, the cam member 124 is brough into engagement with the movable bracket 100 by the second cam surface portion 124*b* thereof and thus allows the movable bracket 100 to be turned out of the operative position thereof by the biasing force to which the bracket 100 is subjected. The cam member 124 is turned into the first or second angular position thereof when the handle 122 is manually operated to turn counter-clockwise from the second angular position or clockwise from the first angular position, respectively, about the center axis of the pivot pin 126. The handle 122 connected to the cam member 124 thus constructed and arranged is shown consisting of a grip portion 122*a* and a stem portion 122*b* intervening between the grip portion 122*a* and the cam member 124 as will be seen from FIGS. 4 to 6**.

Immediately above the bottom disc member 86 and hub 90 of the rotor unit 70 is positioned an upper disc member 130 coaxially surrounded by a lower portion of the rotor cylinder 84 and having a central sleeve portion mounted on an upper end portion of the spindle 92 through a bearing unit 132. The upper disc member 130 has a boss 134 axially projecting downwardly toward the upper face of the bottom disc member 86 of the rotor unit 70 and having a disc-shaped permanent magnet 136 attached to the lower end face of the boss 134 and positioned immediately above the upper face of the bottom disc member 86 of the rotor unit 70 as shown in FIG. 3. On the other hand, the lower disc member 98 is formed with a circular opening 138 located below the above mentioned permanent magnet 136. As illustrated to an enlarged scale in FIG. 7 of the drawings, a flanged, cylindrical sleeve 140 is securely fitted to the disc member 98 with its annular flange portion securely attached to the underside of the disc member 98. The cylindrical sleeve 140 has an upper end wall formed with a circular opening 142 through which a stem 144 is axially slidable in a vertical direction. The stem 144 has securely carried at its upper end a disc-shaped permanent magnet 146 having a vertical center axis substantially aligned with the vertical center axis of the permanent magnet 136 supported by the upper stationary disc member 130 as will be seen from FIG. 3. Each of the permanent magnets 136 and 146 thus positioned on the opposite side of the non-magnetic bottom disc member 86 of the rotor unit 70 is magnetized in such a manner that opposite magnetic poles appear alternately along the outer peripheral end the magnet. Thus, the permanent magnets 136 and 146 supported by the upper and lower stationary disc members 130 and 98 are attracted by each other when the two magnets have about the vertically aligned respective center axes thereof such relative angular positions that the poles of one polarity in one of the magnets are vertically aligned with the poles of the other polarity in the other magnet.

Figure 7:
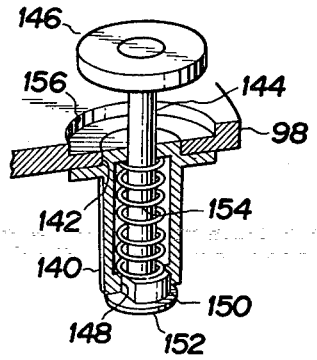
FIG. 7 is a cut-away perspective view showing the restraining means forming part of the magnetic positioning means included in the core yarn supply unit.

The cylindrical sleeve 140 attached to the lower stationary disc member 98 further has a lower end wall formed with a non-circular opening 148. On the other hand, the stem 144 which is passed through the circular opening 138 in the upper end wall of the sleeve 140 axially extends throughout the length of the sleeve 140 and has fixedly carried at its lower end a plug member 150 substantially conforming in cross section to the above mentioned non-circular opening 148. The plug member 150 is thus axially slidable through the non-circular opening 148 in the lower end wall of the sleeve 140 when the plug member 150 assumes a predetermined angular position with respect to the sleeve 140 about the center axis of the stem 144. The plug member 150 has fixedly attached to its lower face a disc-shaped stop element 152 so that the plug member 150 is snugly received in the non-circular opening 148 as shown in FIG. 7 when the permanent magnet 146 is urged upwardly by the attracting forces exerted between the permanent magnets 136 and 146, provided the plug member 150 is in the above mentioned predetermined angular position thereof about the center axis of the stem 144. When the plug member 150 is thus received in the non-circular opening 148 with the stop element 152 attached to the lower end face of the sleeve 140, the permanent magnet 146 connected to the plug member 150 by the stem 144 is positioned immediately below the lower face of the bottom disc member 86 of the rotor unit 70 as shown in FIG. 3. The plug member 150 and accordingly the permanent magnet 146 are urged downwardly by suitable biasing means such as a preloaded helical compression spring 154 which is seated at one end on the inner face of the upper end wall of the sleeve 140 and at the other end on the upper face of the plug member 150 as shown. The lower disc member 98 is formed with a circular depression 156 coaxially encircling the upper end of the circular opening 138 in the disc member 98 and having a bottom face substantially flush with the upper end face of the sleeve 140. The depression 156 forms a seat area for the permanent magnet 146 when the magnet 146 is caused to move downwardly as will be described later.

When the lower and upper disc members 98 and 130 assume the previously mentioned relative angular positions in which the magnetic poles of one polarity in one of the permanent magnets 136 and 146 are vertically aligned with the magnetic poles of the other polarity in the other permanent magnet, the permanent magnet 146 vertically movable with respect to the lower disc member 98 is urged upwardly by the attractive forces exerted between the two magnets 136 and 146. If, in this instance, the plug member 150 assumes with respect to the sleeve 140 the above mentioned angular position aligned with the non-circular opening 148 in the lower end wall of the sleeve 140, the plug member 150 is received in the opening 148 with the stop element 152 closely attached to the lower end face of the sleeve 140 so that the permanent magnet 146 connected to the plug member 152 by the stem 144 is held in an uppermost position above the lower disc member 98. The lower disc member 98 being held stationary with respect to the movable bracket 114, the upper disc member 130 is urged to maintain a predetermined angular position with respect to the lower stationary disc member 98 and is, as a consequence, held stationary with respect to the lower disc member 98 and accordingly to the movable bracket 114 unless the upper disc member 130 happens to be caused to turn from such an angular position about the center axis of the spindle 92. The upper disc member 130 is rotatable on the spindle 92 through the bearing unit 132 but is normally maintained stationary with respect to the movable bracket 114. Thus, the permanent magnets 136 and 146, sleeve 140 and plug member 150 constitute, in combination, magnetic positioning means adapted to hold the upper disc member 130 with respect to the lower stationary disc member 98 and accordingly the movable bracket 114. The sleeve 140 and the plug member 150 in particular constitute restraining means for restraining the permanent magnet 146 from pivotal movement about the center axis thereof with respect to the lower disc member 98.

As shown in FIG. 3, the upper disc member 130 is formed with a circular opening 158 which is located substantially in diametrically opposed relationship to the boss 134 of the disc member 130. In the opening 158 thus formed in the disc member 130 is received a bearing unit 160 in which a hollow rotatable shaft 162 is journaled at one end thereof. The rotatable shaft 162 extends from the bearing unit 160 upwardly within the rotor cylinder 84 of the rotor unit 70 and is rotatable about its vertical center axis with respect to the disc member 130. Furthermore, the rotatable shaft 162 slightly projects downwardly from the bearing unit 160 and has fixedly carried at its lower end a disc-shaped permanent magnet 164 which is positioned immediately above the upper face of the bottom disc member 86 of the rotor unit 70.

On the other hand, the lower disc member 98 is also formed with a circular opening 166 which is located below the opening 158 in the upper disc member 130 held in the above mentioned predetermined angular position with respect to the lower disc member 98. The opening 166 thus formed in the lower disc member 98 has received therein a bearing unit 168 in which a hollow rotatable shaft 170 is journaled at one end thereof. The rotatable shaft 170 slightly projects upwardly from the bearing 168 and has securely carried at its upper end a disc-shaped permanent magnet 172 which is positioned immediately below the lower face of the bottom disc member 86 of the rotor unit 70 as shown in FIG. 3. Furthermore, the rotatable shaft 170 projects downwardly from the bearing unit 168 and is securely connected to a generally drum-shaped rotor 174 having an inner sleeve portion fastened to the rotatable shaft 170 and an outer rim portion coaxially encircling the sleeve portion. An endless auxiliary drive belt 176 extends in part in conjunction with the rotor 174 so that the outer peripheral surface of the rim portion of the rotor 174 is contacted by the drive belt 176 when the movable bracket 100 supporting the lower disc member 98 is held in the previously mentioned predetermined angular position thereof having the spindle 92 contacted by the main drive belt 74. The auxiliary drive belt 176 thus engageable with the rotor 174 forms part of an auxiliary belt and pulley arrangement in the yarn covering apparatus embodying the present invention and is adapted to be driven by the drive means (not shown) for the main belt and pulley arrangement including the drive pulley 74.

Similarly to the previously described permanent magnets 136 and 146, each of the permanent magnets 164 and 172 supported by the rotatable shafts 162 and 170 is magnetized in such a manner that opposite magnetic poles appear alternately along the outer peripheral end of the magnet. Thus, the permanent magnets 164 and 172 are magnetically linked across the bottom disc member 86 of the rotor unit 70 so that, when one of the magnets 164 and 172 is driven to rotate about the center axis of the associated one of the rotatable shafts 162 and 170, the other of the magnets is also driven for rotation about the other of the shafts 162 and 170 provided the upper disc member 130 is held in the previously mentioned predetermined angular position with respect to the lower disc member 98. In the arrangement herein shown, the auxiliary drive belt 176 is assumed by way of example to be driven to travel leftwardly in the drawings as indicated by arrow a in FIGS. 3 and 6 so that the rotor 174 and the permanent magnet 172 and accordingly the permanent magnet 164 and the rotatable shaft 162 are driven to turn about their respective vertical center axes as indicated by arrow b in FIG. 9.

The permanent magnets 164 and 172 and the members associated therewith constitute drive means for the core yarn delivery mechanism 72 (FIG. 2) forming part of the core yarn supply means 50 (FIG. 2) of the yarn covering apparatus embodying the present invention. The core yarn delivery mechanism 72 is disposed within the rotor cylinder 84 of the rotor unit 70 and comprises a pin 178 upstanding from the bottom disc member 86 of the rotor unit 70 as indicated by broken lines in FIG. 8. As will be seen from FIG. 9, the pin 178 is located at a suitable spacing from the rotatable shaft 162 projecting upwardly from the bottom disc member 86 of the rotor unit 70 and is somewhat offset from the axis of rotation of the rotor unit 70. A tubular element 180 is rotatably fitted on the pin 178 and has an arm member 182 securely connected adjacent one end thereof to the upper end of the arm member 182. The arm member 182 extends substantially in parallel with and above the upper face of the upper disc member 130 and has adjacent the other end thereof a pivot pin 184 projecting upwardly from the arm member 182. A cylindrical spool support member 186 is mounted on the pivot pin 184 by means of a bearing 188 and is rotatable about the vertical center axis of the pin 184. The spool support member 186 is not only rotatable about the center axis of the pivot pin 184 connected to the leading end of the arm member 182 but is pivotally movable about the vertical center axis of the pin 178 secured to the upper disc member 130. Thus, the spool support member 184 is movable in an arc with respect to the upper disc member 130 toward and away from the rotatable shaft 162 on the disc member 130 as will be seen from FIG. 9 and is urged to move toward the rotatable shaft 162 by suitable biasing means such as a preloaded helical torsion spring 190 (FIGS. 8 and 9) received around the tubular element 180 and having one end portion hooked to the arm member 182 and the other end portion hooked to the disc member 130. A lever 192 extends substantially horizontally from the lower end of the tubular element 180. The lever 192 is securely connected at one end thereof to the tubular element 180 and has an upstanding leading end portion **192*a* formed with a vertically elongated slot 194 as illustrated in FIG. 4**.

The spool support member 186 is adapted to have releasably supported thereon a spool 196 carrying a roll 198 of a core yarn Y which is wound in layers on the spool 196. During operation of the yarn covering apparatus, the yarn roll 198 on the spool 196 thus supported on the spool support member 186 is pressed against the outer peripheral surface of the rotatable shaft 162 by the force of the above mentioned torsion spring 190. The core yarn Y is thus continuously unwound from the yarn roll 198 by the rotation of the spool support member 186 which is driven by the rotatable shaft 162, as will be discussed in more detail.

Figure 8:
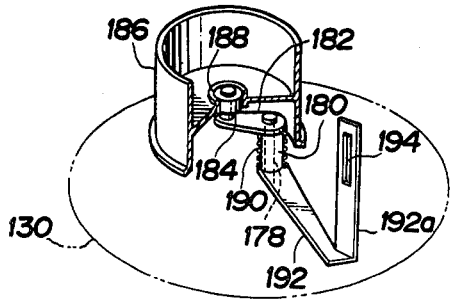
FIG. 8 is a perspective view showing part of the core yarn delivery mechanism included in the core yarn supply unit.
Figure 9:
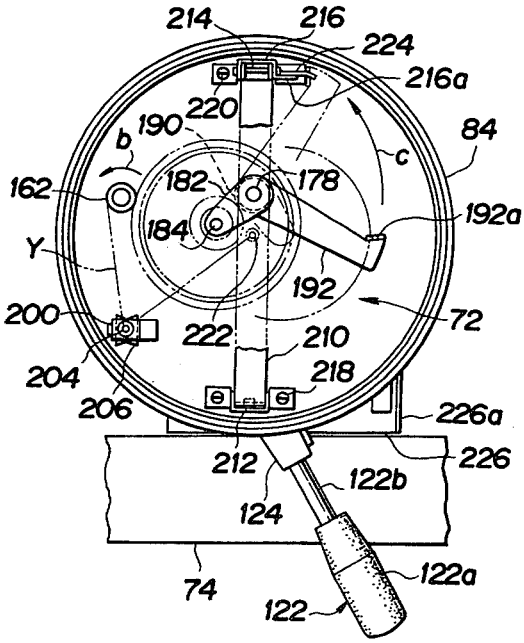
FIG. 9 is a top plan view of the core yarn delivery mechanism included in the core yarn supply unit of the embodiment of the present invention.

To guide the core yarn Y thus unwound from the yarn roll 198 supported on the spool support member 186, the core yarn delivery mechanism 72 further comprises suitable core yarn guide means which is shown comprising a guide support post 200 (FIGS. 3, 4 and 9) positioned in the neighborhood of the rotatable shaft 162 and securely mounted on the upper face of the upper disc member 130 by suitable fastening means such as a screw 202 as shown in FIG. 4. The guide support post 200 extends upwardly from the disc member 130 and has an upper end portion **200*a* perpendicularly bent from the adjacent portion of the post 200 and formed with an aperture 204 adapted to have the core yarn Y passed therethrough. Furthermore, the guide support post 200 has supported on its upstanding portion a grooved guide roller 206 which is rotatable on a pin 208 secured to the guide support post 200. The yarn guide means further comprises an elongated yarn guide beam 210 positioned above the upper disc member 130 in such a manner as to partially protrude above the rotor cylinder 84 of the rotor unit 70 as will be seen from FIG. 3 and to extend substantially diametrically of the rotor cylinder 84 as shown in FIGS. 4 and 9. The core yarn guide beam 210 has one end portion detachably fitted to a support member 212 upstanding from the upper face of the upper disc member 130 and the other end portion pivotally connected by means of a pivot pin 214 (FIG. 9) to a support member 216 positioned in diametrically opposed relationship to the support member 212 and also upstanding from the upper face of the disc member 130. The support members 212 and 216 have lowermost leg portions secured to the upper face of the disc member 130 by suitable fastening means such as screws 218 and 220, respectively as shown in FIGS. 4 and 9. The pin 214 providing pivotal connection between the yarn guide beam 210 and the support member 216 extends substantially horizontally so that the yarn guide beam 210 is pivotally movable with respect to the rotor unit 70 about the horizontal center axis of the pin 214. The yarn guide beam 210 has formed in its intermediate portion an aperture 222 adapted to have the core yarn Y passed therethrough. The core yarn Y unwound from the yarn roll 198 on the spool 196 supported on the spool support member 186 is, thus, passed on to the outer peripheral surface of the rotatable shaft 162 and is thereafter guided through the aperture 204 in the guide support post 200, the grooved guide roller 206 on the guide support post 200 and the aperture 222 in the yarn guide beam 210 to the previously mentioned eyelet element 66 (FIGS. 2 and 3) which is positioned above the rotor unit 70. During operation of the yarn covering apparatus, the rotatable shaft 162 is driven to rotate about its vertical center axis in the direction of the arrow b (FIG. 9) as previously discussed so that the yarn roll 198 pressed against the rotatable shaft 162 by the force of the torsion spring 190 (FIG. 8) is forced to rotate with the spool 196 and the spool support member 186 about the center axis of the pin 184 secured to the leading end portion of the arm member 182. The core yarn Y is thus continuously unwound from the rotating yarn roll 198 and is passed to the guide means via the outer peripheral surface of the rotatable shaft 162 which is driven for rotation about the center axis thereof by the magnetic interaction between the permanent magnet 164 connected to the shaft 162 and the permanent magnet 172 driven by the auxiliary drive belt 176** as previously discussed.

The support member 216 having the yarn guide beam 210 pivotally supported thereon has a lateral projection 216*a* and has a generally L-shaped detent member 224 having an intermediate fulcrum portion pivotally connected to the lateral projection 216*a* by means of a pivot pin 225. The detent member 224 has an upstanding arm portion extending generally upwardly from the fulcrum portion and a hook portion 224*a* angularly spaced apart from the upstanding arm portion about the pivot pin 225 and having a hook directed generally downwardly as shown in FIG. 4. As will be seen from the illustration of FIG. 9, the lever 192 rotatable about the center axis of the pivot pin 178 on the upper disc member 130 as previously described is pivotally movable as indicated by arrow c into an angular position having its upstanding leading end portion 192*a* located adjacent the hook portion 224*a* of the detent member 224 as indicated by phantom lines in FIG. 9. The lever 192 and the detent member 224 are arranged in conjunction with each other so that, when the lever 192 is moved into such an angular position against the force of the torsion spring 190, the hook portion 224*a* of the detent member 224 is engageable with the lever 192 through the slot 194 in the upstanding leading end portion 192*a* of the lever 192 so that the lever 192 is retained to the support member 216 by means of the detent member 224. When the lever 192 is moved into the above mentioned angular position thereof, the spool support member 186 connected to the lever 192 by the tubular element 180 and arm member 182 is turned in an arc about the center axis of the pivot pin 178 into an inoperative angular position having the yarn roll 198 angularly spaced apart from the rotatable shaft 162 as indicated by a phantom line in FIG. 9. When the lever 192 is retained to the support member 216 by means of the detent member 224 as above described, the driving engagement of the rotatable shaft 162 with the yarn roll 198 is cleared so that the yarn roll 198 and accordingly the spool support member 186 cease to rotate about the center axis of the pivot pin 184 on the arm member 182. The spool 196 carried by the spool support member 186 moved into the inoperative angular position thereof is positioned in part below the yarn guide beam 210 as will be seen from FIG. 9 and can be easily removed from the spool support member 186 without being obstructed by the yarn guide beam 210 if the yarn guide beam 210 is disengaged from the support member 212 and upwardly turned about the pivot pin 214 fitted to the support member 216. The lever 192 and the detent member 224 arranged as described above constitute retaining means for retaining the spool support member 186 in the angular position disengaged from the previously described drive means for the core yarn delivery mechanism 72.

The yarn covering apparatus embodying the present invention further comprises an emergency stop mechanism for disengaging the rotor unit 70 from the main drive belt 74 in the event the upper disc member 130 is caused to turn from its correct angular position with respect to the lower disc member 98 about the center axis of the spindle 92 during operation of the yarn covering apparatus. The emergency stop mechanism comprises a horizontal lever support plate 226 secured to the stationary bracket 116 as shown in FIGS. 4 to 6 and having a pair of upstanding edge portions 226*a* which are located in conjunction with the previously described magnetic positioning means and which are spaced apart substantially in parallel from each other, as will be seen from FIG. 5. Above the lever support plate 226 is provided a bell crank lever 228 which has an intermediate fulcrum portion pivotally mounted on the pivot pin 126 supporting the cam member 124 connected to the handle 122 and which is thus rotatable about the vertical center axis of the pivot pin 126 independently of the cam member 124. As will be best seen from FIG. 6, the bell crank lever 228 has a first arm portion extending below the stem portion 122*b* of the handle 122 and a second arm portion angularly spaced apart from the first arm portion about the center axis of the pivot pin 126 and extending approximately in parallel with the path of the main drive belt 74 below the above mentioned magnetic positioning means. The first arm portion of the bell crank lever 228 has at its leading end an upstanding lug 228*a* which is engageable with the stem portion 122*b* of the handle 122 and, likewise, the second arm portion of the lever 228 has a lug 228*b* at its leading end. The bell crank lever 228 thus configured is biased to turn about the center axis of the pivot pin 126 in a clockwise direction in FIG. 6 by suitable biasing means so that the upstanding lug 228*a* of the first arm portion of the lever 228 is urged to press the stem portion 122*b* of the handle 122. The handle 122 is, thus, urged to turn counter-clockwise in FIG. 6 about the center axis of the pivot pin 126 so that the cam member 124 connected to the handle 122 is urged to turn toward the previously mentioned second angular position thereof having its second cam surface portion 124*b* contacted by the vertical surface portion 128 of the movable bracket 100. In the embodiment herein illustrated, the biasing means to achieve these functions is shown comprising a preloaded helical torsion spring 230 (FIGS. 5 and 6) received around the pivot pin 126 and having one end portion retained to the support plate 226 and the other end portion retained to the first arm portion of the bell crank lever 228.

The above mentioned emergency stop mechanism further comprises a rocker 232 having an intermediate fulcrum portion pivotally mounted on a pivot pin 234 secured to the above mentioned upstanding edge portions 226*a* of the lever support plate 226 and directed approximately in parallel with the second arm portion of the bell crank lever 228 as will be seen from FIG. 6. The rocker 232 has a first arm portion 232*a* extending above the second arm portion of the bell crank lever 228 and a second arm portion 232*b* extending below the sleeve 140 of the magnetic positioning means, as will be seen from FIGS. 4 to 6. The first arm portion 232*a* of the rocker 232 has formed at its leading end a downwardly projecting hook engageable with the upstanding lug 228*b* of the second arm portion of the bell crank lever 228. When the lug 228*b* of the second arm portion of the bell crank lever 228 is engaged by the hook of the first arm portion of the rocker 232, the bell crank lever 228 is, about the center axis of the pivot pin 126, held in a first angular position having its lug 228*a* disengaged from the stem portion 122*b* of the handle 122 against the force of the torsion spring 230, allowing the cem member 124 to remain in its first angular position having the first cam surface portion 124*a* held in contact with the vertical surface portion 128 of the movable bracket 100 and thereby maintaining the movable bracket 100 in the previously mentioned operative position thereof. When the rocker 232 is disengaged from the upstanding lug 228*b* of the second arm portion of the bell crank lever 228 as will be discussed in more detail, the bell crank lever 228 is caused to turn clockwise in FIG. 6 from its first angular position toward a second angular position about the center axis of the pivot pin 126 and, by the upstanding lug 228*a* of the first arm portion thereof, forces the cam member 124 to turn in the same direction from the first angular position toward the second angular position thereof about the center axis of the pin 126 until the second cam surface portion 124*b* of the cam member 124 is brought into contact with the vertical surface portion 128 of the movable bracket 100. The rocker 232 is provided with suitable biasing means adapted to urge the rocker 232 counter-clockwise in FIG. 5 about the center axis of the pivot pin 234, viz., in a direction to have the hook of its first arm portion 232*a* engaged by the upstanding lug 228*b* of the second arm portion of the bell crank lever 228. In the embodiment herein illustrated, such biasing means is shown comprising a preloaded helical torsion spring 236 received around the pivot pin 234 and having one end portion retained to the lever support plate 226 and the other end portion retained to the second arm portion 232*b* of the rocker 232 as indicated by broken lines in FIGS. 5 and 6 of the drawings. To prevent angular movement of the cam member 124 beyond the first angular position thereof about the center axis of the pivot pin 126 a suitable stop element 238 is mounted on the lever support plate 226 as shown in FIG. 6.

As indicated by dotted lines in FIG. 3 of the drawings, furthermore, the spindle 92 is formed with an axial passageway 240 which is open at the lower end of the spindle 92 and which longitudinally extends upwardly from the lower end, and a radial passageway 242 which is formed in an upper end portion of the spindle 92 and which merges laterally out of the upper end of the axial passageway 240. On the other hand, the hub 90 and the bottom disc member 86 of the rotor unit 70 are formed with radial passageways 244 and 246, respectively, which are aligned with and open to each other. The radial passageway 242 in the upper end portion of the spindle 92 is open at its leading end to the radial passageway 244 in the hub 90 while the radial passageway 246 in the bottom disc member 86 of the rotor unit 70 is open at its outer end to an aperture 248 formed in the cylindrical rotor cylinder 84 of the rotor unit 70. A continuous path for the passage of the covering yarn Y' is thus provided from the lower end of the spindle 92 to the aperture 248 in the rotor cylinder 84 so that the covering yarn Y' unwound from the yarn package 60 (FIG. 2) positioned below the rotor unit 70 can be passed to the aperture 248 in the rotor cylinder 84 through the axial and radial passageways 240 and 242 in the spindle 70 and the radial passageways 244 and 246 in the hub 90 and bottom disc member 86, respectively, of the rotor unit 70.

Description will be hereinafter made regarding the mode of operation of the yarn covering apparatus constructed and arranged as hereinbefore described.

Prior to the start of the yarn covering apparatus, the spool 196 carrying the roll 198 of the core yarn Y is fitted to the spool support member 186 on the bottom disc member 86 of the rotor unit 70. In this instance, the lever 192 rotatable about the center axis of the pivot pin 178 projecting from the bottom disc member 86 of the rotor unit 70 is preliminarily moved in the direction of the arrow c into the angular position adjacent the support member 216 on the disc member 86 and is engaged by the hook portion 224*a* of the detent member 224 on the support member 216 through the aperture 194 in the upstanding portion 192*a* of the lever 192 as indicated by phantom lines in FIG. 9. The spool support member 186 rotatable with the lever 192 about the center axis of the pivot pin 178 is thus held in the previously mentioned inoperative angular position spaced apart from the rotatable shaft 162 projecting from the disc member 86 of the rotor unit 70 and is free to rotate about the center axis of the pivot pin 184 upstanding from the arm member 182 (FIG. 8). A leading end portion of the core yarn Y is then unwound from the yarn roll 198 and is passed on to the outer peripheral surface of the rotatable shaft 162 and further through the aperture 204 in the yarn guide support post 200 and via the grooved guide roller 206 on the guide support post 200 to the aperture 222 in the yarn guide beam 210 fitted at its free end to the support member 212, as indicated by dash-and-dots lines in FIG. 9. The core yarn Y thus passed through the aperture 222 in the yarn guide beam 210 is directed upwardly through the aperture 68 in the eyelet element 66 (FIGS. 2 and 3) positioned above the rotor unit 70 and further by way of the tension roller 76 and the guide bars 78 and 78' to the take-up unit 80 shown in FIG. 2. On the other hand, a leading end portion of the covering yarn partially unwound from the yarn package 70 (FIG. 2) is directed upwardly by way of the guide bars 62 and 62' and the tension roller unit 64 and is passed through the passageways 240 and 242 in the spindle 92, the radial passageways 244 and 246 in the hub 90 and bottom disc member 86, respectively, of the rotor unit 70 and the aperture 248 in the rotor cylinder 84 of the rotor unit 70. The covering yarn Y' thus leading from the aperture 248 in the rotor cylinder 84 is drawn upwardly past the upper end of the cylinder 84 and is passed through the aperture 68 in the eyelet element 66. The leading end portion of the covering yarn Y' passed through the aperture 68 in the eyelet element 66 is manually entwined around or spliced to the core to the yarn Y immediately above the aperture 68. Upon completion of these steps, the detent member 224 is manipulated to allow the lever 192 to be disengaged from the hook portion 224*a* of the detent member 224 and to be moved back by the force of the torsion spring 190 into the angular position having the yarn roll 198 held in rollable contact with the rotatable shaft 162 as shown in FIG. 4.

When the yarn covering apparatus is not in operation, the cam member 124 is held in the previously mentioned second angular position thereof about the center axis of the pivot pin 126 and has its second cam surface portion 124*b* contacted by the vertical surface portion 128 (FIG. 6) of the upper arm portion 102 of the movable bracket 100. The movable bracket 100 is therefore maintained, about the center axis of the pivot pin 118, in an angular position having the spindle 92 and rotor 174 spaced apart from the main and auxilliary drive belts 74 and 176, respectively.

Before the yarn covering apparatus is put into operation, the handle 122 is manipulated to turn counter-clockwise in FIG. 6 so that the cam member 124 is caused to turn about the center axis of the pivot pin 126 from the first angular position into the second angular position thereof. The cam member 124 being thus moved into the second angular position thereof, the first cam surface portion 124*a* of the cam member 124 is brought into contact with the vertical surface portion 128 of the movable bracket 100, which is therefore caused to turn about the center axis of the pivot pin 126 into its operative position having the spindle 92 and rotor 174 contacted by the main and auxiliary drive belts 74 and 176, respectively.

When the drive means for the main and auxiliary belt and pulley arrangements is actuated under these conditions, the spindle 92 of the rotor unit 70 and the rotor 174 forming part of the core yarn delivery mechanism 72 (FIG. 2) are driven to rotate about their respective center axes by the main and auxiliary drive belts 74 and 176, respectively. The rotation of the rotor 174 driven by the auxiliary drive belt 176 is transmitted through the shaft 170 to the permanent magnet 172 at the upper end of the shaft 170 and further to the permanent magnet 164 above the magnet 172 by the magnetic interaction between the permanent magnets 164 and 172 which are vertically aligned with each other across the non-magnetic bottom disc member 86 of the rotor unit 70. Thus, the rotatable shaft 162 connected to the permanent magnet 164 is driven to rotate about its center axis with respect to the upper disc member 130 which is held at rest with respect to the movable bracket 100 by the interaction between the permanent magnet 136 secured to the upper disc member 130 and the permanent magnet 146 supported by the lower stationary disc member 98. While the rotatable shaft 162 is being thus driven to rotate about the center axis thereof, the rotor unit 70 including the spindle 92 is driven to rotate about the center axis thereof by means of the main drive belt 74.

By the rotation of the rotatable shaft 162, the yarn roll 198 pressed against the rotatable shaft 162 by means of the torsion spring 178 (FIG. 8) is driven to rotate with the spool support member 186 about the center axis of the pivot pin 184 on the arm member 182 so that the core yarn Y is continuously unwound from the yarn roll 198. The core yarn Y thus unwound from the yarn roll 198 is passed via the outer peripheral surface of the rotating shaft 162 and thence through the aperture 204 in the yarn guide support post 200 and the grooved guide roller 208 to the aperture 222 in the yarn guide beam 210 as shown in FIGS. 4 and 9 of the drawings. From the aperture 222 in the yarn guide beam 210, the core yarn Y is passed upwardly through the aperture 68 in the eyelet element 66 positioned above the rotor unit 70 (FIGS. 2 and 3).

While the core yarn Y is being thus fed from the core yarn delivery mechanism 72 (FIGS. 2 and 9), the covering yarn Y' is unwound from the yarn package 60 positioned below the rotor unit 70 and is continuously fed upwardly by way of the yarn guide bars 62 and 62' and the tension roller unit 64 (FIG. 2). The covering yarn Y' is then passed through the axial and radial passageways 240 and 242 in the rotating spindle 92 and thence through the radial passageways 244 and 246 in the hub 90 and bottom disc member 86, respectively, of the rotating rotor unit 70 and is directed upwardly from the aperture 248 in the rotor cylinder 84 of the rotor unit 70 to the aperture 68 in the eyelet element 66 (FIGS. 2 and 3).

While the core and covering yarns Y and Y' are thus being passed upwardly through the aperture 68 in the eyelet element 66, the rotor unit 70 is driven for rotation about the center axis of the spindle 92 so that the covering yarn Y leading from the aperture 248 in the rotor cylinder 84 of the rotating rotor unit 70 is turned about the center axis of the spindle 92 and is caused to entwine around the core yarn Y immediately above the aperture 68 in the eyelet element 66, thereby forming a covered thread T. As illustrated in FIG. 2, the covered thread thus produced above the aperture 68 in the eyelet element 66 is upwardly conveyed through the tension roller unit 76 and through the yarn guide bars 78 and 78' and is wound into roll form by means of the take-up unit 80.

Throughout operation of the yarn covering apparatus thus operative, the upper disc member 130 is urged to maintain the previously mentioned predetermined angular position with respect to the lower disc member 98 by the magnetic interaction between the permanent magnets 136 and 146 supported by the upper and lower disc members 130 and 98, respectively, as previously discussed. Under these conditions, the permanent magnet 146 supported by the lower disc member 98 is held in its uppermost position with respect to the sleeve 140 secured to the disc member 98 against the force of the compression spring 154 in the sleeve 140 with the plug member 150 snugly received in the non-circular opening 148 in the lower end wall of the sleeve 140 as shown in FIG. 7.

If it happens that the upper disc member 130 is caused to turn about the center axis of the spindle 92 from the correct angular position with respect to the lower disc member 98 by an external force imparted to the disc member 130 during operation of the yarn covering apparatus, the vertical alignment between the permanent magnets 136 and 146 is destroyed and, as a consequence, the magnetic poles of one polarity of the permanent magnet 136 secured to the upper disc member 130 are caused to deviate from the positions vertically aligned with the magnetic poles of the other polarity of the permanent magnet 146 supported by the lower disc member 98. The lower disc member 98 is therefore urged to follow the angular displacement of the upper disc member 130 and, likewise, the permanent magnet 146 supported by the lower disc member 98 is urged to turn about the center axis thereof with respect to the disc member 98. Since, however, the lower disc member 98 is secured to the movable bracket 100 which is held in the operative position by means of the cam member 124 as previously described, the disc member 98 is prohibited from following the angular displacement of the upper disc member 130. Similarly, the permanent magnet 146 supported by the lower disc member 98 is prohibited from turning about the center axis thereof with respect to the disc member 98 by the engagement between the plug member 150 and the lower end wall of the sleeve 140 (FIG. 7). Immediately upon destruction of the alignment between the permanent magnets 136 and 146, therefore, the poles of the like polarities of the upper and lower permanent magnets 136 and 146 are momentarily aligned with each other on both sides of the non-magnetic bottom disc member 86 of the rotor unit 70 so that the permanent magnets 136 and 146 are urged vertically away from each other. The permanent magnet 136 being secured to the upper disc member 130 and the permanent magnet 146 being downwardly movable with respect to the lower disc member 98, the permanent magnet 146 is caused to move downwardly by the repulsive forces exerted between the magnets 136 and 146 and the force of the compression spring 154 into its lowermost position seated in the depression 156 formed in the lower disc member 98.

By the downward movement of the permanent magnet 146, the plug member 150 connected to the magnet 146 by the stem 144 is caused to project downwardly from the non-circular opening 148 in the lower end wall of the sleeve 140 secured to the lower disc member 98 and strikes against the second arm portion 232*b* of the rocker 232 (FIGS. 5 and 6). It therefore follows that the rocker 232 is caused to turn counter-clockwise in FIG. 5 about the center axis of the pivot pin 234 against the force of the torsion spring 236 and has its arm portion 232*a* angularly raised above the upstanding lug 228*b* of the second arm portion of the bell crank lever 228, thereby allowing the bell crank lever 228 to be disengaged from the hook of the first arm portion 232*a* of the rocker 232. The bell crank lever 228 is therefore caused to turn clockwise in FIG. 6 about the center axis of the pivot pin 126 by the force of the torsion spring 230 and, as a consequence, the upstanding lug 228*a* of the first arm portion of the bell crank lever 228 is brought into pressing contact with the stem portion 122*b* of the handle 122. Thus, the handle 122 and accordingly the cam member 124 connected to the handle 122 are forced to turn about the center axis of the pivot pin 126 by the torsion spring 230 until the cam member 124 and the bell crank lever 228 reach their respective second angular positions having the second cam surface portion 124*b* of the cam member 124 brought into contact with the vertical surface portion 128 (FIG. 6) of the upper arm portion 102 of the movable bracket 100. The cam member 124 being thus moved into the second angular position thereof, the movable bracket 100 urged to turn clockwise in FIG. 6 about the center axis of the pivot pin 116 is allowed to be moved from the previously mentioned predetermined position thereof and causes the spindle 92 and the rotor 174 (FIG. 3) to be disengaged from the main and auxiliary drive belts 74 and 176. The spindle 92 and the rotor 174 and accordingly the rotor unit 70 and the yarn roll 198 are now allowed to cease rotation about their respective axes, enabling the operator to troubleshoot the apparatus.

It will have been appreciated from the foregoing description that one of the outstanding features of the yarn covering apparatus proposed by the present invention is the arrangement in which the package of the covering yarn is positioned externally and independently of the rotor unit 72. A wide selection of sizes is therefore allowed of the package of the covering yarn without respect to the size of the rotor unit 72 so that it is not required to frequently refurnish fresh packages of covering yarn during operation of the yarn covering apparatus. This will not only contribute to enhancement of the production efficiency but permit realization of a fully automated yarn covering apparatus.

Another outstanding feature of the yarn covering apparatus according to the present invention is the arrangement in which the upper disc member 130 supporting the core yarn delivery mechanism 72 (FIGS. 2 and 9) is held with respect to the lower stationary disc member 98 by means of the permanent magnets 136 and 146 while the yarn roll 198 of the covering yarn Y is driven for rotation with respect to the upper disc member 130 by the drive means including the permanent magnets 164 and 172. The permanent magnets 136 and 164 are spaced apart from the permanent magnets 146 and 174, respectively, across the non-magnetic bottom disc member 86 of the rotor unit 72 so that the covering yarn Y' being passed though the passageways 240, 242, 244 and 246 formed in the rotor unit 72 and concurrently turned about the center axis of the rotor unit 70 is not interfered with by any of these magnets and the members associated therewith.

A third outstanding feature of the yarn covering apparatus herein proposed is the provision of the emergency stop mechanism which is adapted to bring the apparatus to a stop in the event the upper disc member 130 happens to be misaligned with the lower disc member 98 during operation of the apparatus. This will contribute to reduction of the failures which may be brought about during production of covered threads.

While only one preferred embodiment of a yarn covering apparatus according to the present invention has been described with reference to the drawings, such an embodiment is merely illustrative of the subject matter of the present invention and may therefore be modified and/or changed in numerous manners if desired.

What is claimed is:

1. A yarn covering apparatus comprising:

a rotor unit having a center axis therethrough and including a first rotatable member rotatable about said center axis and formed with a passageway which is adapted to have a covering yarn passed therethrough and which is open at the outer end of the rotatable member;

first and second members spaced apart from each other with rotatable member positioned therebetween the first member being held stationary with respect to the center axis of said rotor unit and the second member being rotatable about said center axis with respect to the rotor unit;

positioning means arranged carried in part on said first member and in part on said second member and operative to urge the second member to stay in a predetermined angular position about said center axis with respect to said first member;

a core yarn delivery mechanism supported on said second member and including a second rotatable member having a center axis therethrough and rotatable about the center axis thereof with respect to the second member;

first drive means operative to drive said rotor unit for rotation about the center axis thereof; and second drive means arranged carried in part on said first member and in part on said second member of the rotor unit and operative to drive the second rotatable member of said core yarn delivery mechanism for rotation about said center axis thereof.

2. A yarn covering apparatus as set forth in claim 1, in which said positioning means comprises two permanent magnets which are supported by said first and second members, respectively, and which are substantially aligned with each other when said second member is held in said predetermined angular position with respect to said first member.

3. A yarn covering apparatus as set forth in claim 2, in which each of said permanent magnets of said positioning means has opposite magnetic poles arranged alternately to one another along the outer circumference of the magnet.

4. A yarn covering apparatus as set forth in claim 1 or 2, in which said second drive means comprises two further substantially circular permanent magnets which are supported by said first and second members, respectively, and which have respective center axes substantially aligned with each other when said second member is held in said predetermined angular position with respect to said first member, said further permanent magnets of the second drive means being rotatable about the respective center axes thereof with respect to said first and second members, respectively, the further permanent magnet forming part of the second drive means and supported by said second member being connected to and rotatable with the second rotatable member of said core yarn delivery mechanism.

5. A yarn covering apparatus as set forth in claim 4, in which said second rotatable member of said core yarn delivery mechanism is connected at one end to the further permanent magnet forming part of said second drive means and supported by said second member and axially projects from the second member in a direction substantially opposite to the further permanent magnet forming part of said second drive means and supported by the second member, said second rotatable member of the core yarn delivery mechanism being rotatable about an axis substantially aligned with the center axis of the further permanent magnet forming part of said second drive means and supported by the second member.

6. A yarn covering apparatus as set forth in claim 5, in which each of said further permanent magnets has opposite magnetic poles arranged alternately to one another along the outer circumference of the magnet.

7. A yarn covering apparatus as set forth in claim 4, in which said second drive means further comprises a third rotatable member which is connected to the further permanent magnet forming part of said second drive means and supported by said first member and which axially projects from the first member in a direction opposite to the other further permanent magnet of the second drive means, said third rotatable member of the second drive means being rotatable about an axis substantially aligned with the center axis of the further permanent magnet forming part of the second drive means and supported by said first member.

8. A yarn covering apparatus as set forth in claim 7, in which said rotor unit further includes a spindle secured to said first rotatable member of the rotor unit and having a center axis substantially coincident with the center axis of the rotor unit, said second member being rotatable on said spindle about the center axis of the spindle.

9. A yarn covering apparatus as set forth in claim 8, in which said spindle is formed with an axial passageway which is open at one end of the spindle and which is in constant communication with said passageway in the first rotatable member of said rotor unit.

10. A yarn covering apparatus as set forth in claim 8, in which said first drive means comprises an endless drive belt in part extending in a direction substantially perpendicular in non-intersecting relationship to the center axis of said spindle and in which the spindle is engageable with said drive belt for being driven to rotate about the center axis thereof when the drive belt is driven to travel.

11. A yarn covering apparatus as set forth in claim 10, further comprising a movable support member which is pivotally movable about a fixed pivotal axis substantially parallel with the center axis of said spindle and which has securely supported thereon said first member so that said rotor unit and first and second members are pivotally movable together about said fixed pivotal axis.

12. A yarn covering apparatus as set forth in claim 11, in which said rotor unit is pivotally movable with said movable support member about said fixed pivotal axis into and out of a predetermined angular position having said spindle contacted by said drive belt.

13. A yarn covering apparatus as set forth in claim 12, in which said movable support member is pivotally movable about said fixed pivotal axis into and out of a predetermined angular position thereof.

14. A yarn covering apparatus as set forth in claim 13, further comprising a manually operable cam member which is rotatable about a fixed axis substantially parallel with said fixed pivotal axis of said movable support member and which is engageable with said movable support member, said cam member being rotatable about said fixed axis thereof into and out of a predetermined angular position having said movable support member in said predetermined angular position thereof.

15. A yarn covering apparatus as set forth in claim 14, in which said cam member has a first cam surface portion to be in contact with said movable support member when the cam member is in said predetermined angular position thereof about said fixed pivotal axis thereof and a second cam surface portion to be in engagement with the movable support member when the cam member is out of said predetermined angular position thereof about said fixed pivotal axis thereof.

16. A yarn covering apparatus as set forth in claim 14, further comprising a handle connected to said cam member.

17. A yarn covering apparatus as set forth in claim 13, further comprising biasing means urging said movable support member away from said predetermined angular position thereof about said fixed pivotal axis thereof.

18. A yarn covering apparatus as set forth in claim 11, in which said second drive means further comprises an endless drive belt in part extending in a direction substantially perpendicular in non-intersecting relationship to the axis of rotation of said third rotatable member of the second drive means and in which the third rotatable member of the second drive means is engageable with said drive belt of the second drive means of being driven to rotate about the axis of rotation thereof when the drive of the second drive means is driven to travel.

19. A yarn covering apparatus as set forth in claim 7, in which said second drive means further comprises an endless drive belt in part extending in a direction substantially perpendicular in non-intersecting relationship to the axis of rotation of said third rotatable member of the second drive means and in which the third rotatable member of the second drive means is engageable with said drive belt for being driven to rotate about the axis of rotation thereof when the drive belt is driven to travel.

20. A yarn covering apparatus as set forth in claim 19, in which said rotor unit comprises a spindle secured to said first rotatable member of the rotor unit and having a center axis substantially coincident with the center axis of the rotor unit, said second member being rotatable on said spindle about the center axis of the spindle.

21. A yarn covering apparatus as set forth in claim 20, in which said spindle is formed with an axial passageway which is open at one end of the spindle and which is in constant communication with said passageway in the rotatable member of said rotor unit.

22. A yarn covering apparatus as set forth in claim 20, in which said first drive means comprises an endless drive belt in part extending in a direction substantially perpendicular in non-intersecting relationship to the center axis of said spindle and in which the spindle is engageable with said drive belt of the first drive means for being driven to rotate about the center axis thereof when the drive belt of the first drive means is driven to travel.

23. A yarn covering apparatus as set forth in claim 22, further comprising a movable support member which is pivotally movable about a fixed pivotal axis substantially parallel with the center axis of said spindle and which has securely supported thereon said first member so that said rotor unit and said first and second members are pivotally movable together about said fixed pivotal axis.

24. A yarn covering apparatus as set forth in claim 23, in which said rotor unit is pivotally movable with said movable support member about said fixed pivotal axis into and out of a predetermined angular position having said spindle contacted by said drive belt of the first drive means.

25. A yarn covering apparatus as set forth in claim 24, in which said movable support member is pivotally movable about said fixed pivotal axis into and out of a predetermined angular position having said rotor unit in said predetermined angular position thereof.

26. A yarn covering apparatus as set forth in claim 25, further comprising a manually operable cam member which is rotatable about a fixed axis substantially parallel with said fixed pivotal axis of said movable support member and which is engageable with said movable support member, said cam member being rotatable about said fixed axis thereof into and out of a predetermined angular position having said movable support member in said predetermined angular position thereof.

27. A yarn covering apparatus as set forth in claim 26, in which said cam member has a first cam surface portion to be in contact with said movable support member when the cam member is in said predetermined angular position thereof about said fixed pivotal axis thereof and a second cam surface portion to be in engagement with the movable support member when the cam member is out of said predetermined angular position thereof about said fixed pivotal axis thereof.

28. A yarn covering apparatus as set forth in claim 26, further comprising a handle connected to said cam member.

29. A yarn covering apparatus as set forth in claim 25, further comprising biasing means urging said movable support member away from said predetermined angular position thereof about said fixed pivotal axis of the support member.

30. A yarn covering apparatus as set forth in claim 7, in which said core yarn delivery mechanism further includes an arm member rotatable about an axis which is fixed with respect to said second member and which is substantially parallel with the center axis of said second rotatable member of the core yarn delivery mechanism, a yarn package support member rotatable about an axis which is fixed with respect to said arm member and which is substantially parallel with the axis of rotation of the arm member, said yarn package support member being adapted to have supported thereon a yarn package of core yarn and being pivotally movable with respect to said second member about the axis of rotation of said arm member into and out of an angular position to have said yarn package engaged by said second rotatable member of the core yarn delivery mechanism.

31. A yarn covering apparatus as set forth in claim 30, in which said yarn delivery mechanism further includes a lever rotatable with said arm member about the axis of rotation of the arm member and a detent member supported by said second member and engageable with said lever for holding said yarn package support member in an angular position spaced apart from said second rotatable member of the core yarn delivery mechanism when the detent member is in engagement with said lever.

32. A yarn covering apparatus as set forth in claim 31, in which said lever has a portion formed with a slot and in which said detent member is rotatable about an axis fixed with respect to said second member and has a hooked arm portion engageable with said lever through said slot.

33. A yarn covering apparatus as set forth in claim 30, in which said core yarn delivery mechanism further includes biasing means urging said arm member to turn about the axis of rotation thereof toward said second rotatable member of the core yarn delivery mechanism.

34. A yarn covering apparatus as set forth in claim 30, in which said rotor unit further comprises a hollow rotor cylinder secured to said first rotatable member of the rotor unit and axially extending from the first rotatable member in a direction to have said second member substantially coaxially positioned therewithin and in which said rotor cylinder is formed with an aperture, said passageway in the first rotatable member of the rotor unit being open at its leading end to said aperture in the rotor cylinder.

35. A yarn covering apparatus as set forth in claim 30, in which said core yarn delivery mechanism further includes guide means arranged on said second member for guiding the core yarn from the yarn package supported on said support member when the yarn covering apparatus is in operation.

36. A yarn covering apparatus as set forth in claim 35, in which said guide means comprises a yarn guide member mounted on said second member and formed with an aperture adapted to have a covering yarn passed therethrough.

37. A yarn covering apparatus as set forth in claim 36, in which said yarn guide member is pivotally movable about an axis fixed with respect to said second member and directed substantially perpendicularly in non-intersecting relationship to the center axis of said rotor unit and has a free end portion engageable with said second stationary member.

38. A yarn covering apparatus as set forth in claim 37, in which said aperture in said yarn guide member is located substantially in line with the center axis of said rotor unit when the yarn guide member is, about the pivotal axis thereof, in an angular position engaging said second member.

39. A yarn covering apparatus as set forth in claim 4, in which said first rotatable member of said rotor unit is constructed of a non-magnetic material.

40. A yarn covering apparatus as set forth in claim 2, in which the permanent magnet forming part of said positioning means and supported by said first member is a movable permanent magnet axially movable between the first member and the first rotatable member of said rotor unit into and out of a predetermined axial position closest to the permanent magnet forming part of said positioning means and supported by said second member and in which the permanent magnet forming part of said positioning means and supported by said second member is secured to the second member, each of the two permanent magnets having opposite magnetic poles which are arranged alternately to each other along the outer circumference of the magnet.

41. A yarn covering apparatus as set forth in claim 40, further comprising an emergency stop mechanism operatively engaging said rotor unit and responsive to the movement of said axially movable permanent magnet away from said predetermined axial position thereof for being operative to cause the rotor unit to cease rotation about the center axis thereof when said axially movable permanent magnet is axially moved away from the permanent magnet forming part of said positioning means and supported by said second member.

42. A yarn covering apparatus as set forth in claim 41, further comprising a movable support member which is pivotally movable about a fixed pivotal axis substantially parallel with the center axis of said spindle and which has securely supported thereon said first member so that said rotor unit and said first and second members are pivotally movable together about said fixed pivotal axis.

43. A yarn covering apparatus as set forth in claim 41, in which said rotor unit is pivotally movable with said movable support member about said fixed pivotal axis into and out of a predetermined angular position having said spindle contacted by said drive belt.

44. A yarn covering apparatus as set forth in claim 43, in which said movable support member is pivotally movable about said fixed pivotal axis into and out of a predetermined angular position having said rotor unit in said predetermined angular position thereof.

45. A yarn covering apparatus as set forth in claim 44, in which said emergency stop mechanism comprises a first lever having a first angular position allowing said movable support member to stay in said predetermined angular position thereof and a second angular position allowing the movable support member to turn out of said predetermined angular position thereof about said fixed pivotal axis and a second lever having a first angular position engageable with said first lever for holding the first lever in said first angular position thereof and a second angular position allowing the first lever to be disengaged from the second lever and to turn from the first angular position into the second angular position thereof, said second lever being responsive to the movement of said axially movable permanent magnet away from the permanent magnet supported by said second member.

46. A yarn covering apparatus as set forth in claim 45, further comprising a manually operable cam member which is rotatable about a fixed axis substantially parallel with said fixed pivotal axis of said movable support member and which is engageable with the movable support member, said cam member being rotatable about said fixed axis thereof into and out of a predetermined angular position having said movable support member in said predetermined angular position thereof.

47. A yarn covering apparatus as set forth in claim 46, in which said first lever is pivotally movable between the first and second angular position thereof about said fixed axis of said cam member and is rotatable independently of the cam member, the first lever being disengaged from the cam member for allowing the cam member to stay in said predetermined angular position when the first lever is in said first angular position thereof and being in engagement with the cam member for allowing the cam member to turn out of the predetermined angular position thereof about said fixed axis of the cam member when said first lever is in said second angular position thereof.

48. A yarn covering apparatus as set forth in claim 47, in which said cam member has a first cam surface portion to be in contact with said movable support member when the cam member is in said predetermined angular position thereof about said fixed axis of the cam member and a second cam surface portion to be in contact with said movable support member when the cam member is out of said predetermined angular position thereof about said fixed axis of the cam member.

49. A yarn covering apparatus as set forth in any one of claims 45 to 48, in which said emergency stop mechanism further comprises biasing means urging said first lever to turn from said first angular position toward said second angular position thereof about said fixed axis of said cam member and biasing means urging said second lever to hold said first angular position thereof.

50. A yarn covering apparatus as set forth in any one of claim 44 to 48, further comprising biasing means urging said movable support member away from said predetermined angular position thereof about said fixed pivotal axis of the support member.

51. A yarn covering apparatus as set forth in any one of claims 46 to 48, further comprising a handle connected to said cam member.

52. A yarn covering apparatus as set forth in claim 44, in which said emergency stop mechanism comprises lever means engageable with said movable support member and having a first condition allowing the movable support member to stay in said predetermined angular position thereof and a second condition allowing the movable support member to turn out of the predetermined angular position thereof, said positioning means being disconnected from said lever means for allowing the lever means to maintain the first condition thereof when said axially movable permanent magnet supported by said first member is held in said predetermined axial position thereof and being operative to actuate said lever means into the second condition thereof when said movable permanent magnet is moved out of said predetermined axial position thereof.

53. A yarn covering apparatus as set forth in claim 52, in which said positioning means comprises restraining means for restraining said axially movable permanent magnet from pivotal movement about the center axis thereof with respect to said first member when the movable permanent magnet is held in said predetermined axial position thereof.

54. A yarn covering apparatus as set forth in claim 53, in which said restraining means comprises a sleeve secured to said first member and having a wall portion formed with a non-circular opening, and a plug member which is axially movable with said movable permanent magnet with respect to said first member and said sleeve in a direction substantially parallel with the center axis of said rotor unit and which has a non-circular cross section substantially conforming to said non-circular opening in said wall portion of the sleeve, said plug member being received in said non-circular opening when said movable permanent magnet is held in said predetermined axial position thereof and being engageable with said lever means when the movable permanent magnet is out of said predetermined axial position thereof.

55. A yarn covering apparatus as set forth in claim 54, in which said lever means comprises a first lever having a first angular position allowing said movable support member to stay in said predetermined angular position thereof and a second angular position allowing the movable support member to turn out of the predetermined angular position thereof, and a second lever having a first angular position engageable with said first lever for holding the first lever in said first angular position thereof and a second angular position allowing the first lever to be disengaged from the second lever and to turn from the first angular position into the second angular position thereof, said plug member being engageable with said first lever so that the first lever is turned into said second angular position thereof when said axially movable permanent magnet is moved out of said predetermined axial position thereof.

56. A yarn covering apparatus as set forth in claim 55, further comprising a manually operable cam member which is rotatable about a fixed axis substantially parallel with said fixed pivotal axis of said movable support member and which is engageable with the movable support member, said cam member being rotatable about said fixed axis thereof into and out of a predetermined angular position having said movable support member in said predetermined angular position thereof.

57. A yarn covering apparatus as set forth in claim 56, in which said first lever is pivotally movable between the first and second angular position thereof about said fixed axis of said cam member and is rotatable independently of the cam member, the first lever being disengaged from the cam member for allowing the cam member to stay in said predetermined angular position when the first lever is in said first angular position thereof and being in engagement with the cam member for allowing the cam member to turn out of the predetermined angular position thereof about said fixed axis of the cam member when said first lever is in said second angular position thereof.

58. A yarn covering apparatus as set forth in claim 57, in which said cam member has a first cam surface portion to be in contact with said movable support member when the cam member is in said predetermined angular position thereof about said fixed axis of the cam member and a second cam surface portion to be in contact with said movable support member when the cam member is out of said predetermined angular position thereof about said fixed axis of the cam member.

59. A yarn covering apparatus as set forth in any one of claims 55 to 58, in which said emergency stop mechanism further comprises biasing means urging said first lever to turn from said first angular position toward said second angular position thereof about said fixed axis of said cam member and biasing means urging said second lever to hold said first angular position thereof.

60. A yarn covering apparatus as set forth in any one of claims 52 to 58, further comprising biasing means urging said movable support member away from said predetermined angular position thereof about said fixed pivotal axis of the support member.

61. A yarn covering apparatus as set forth in any one of claims 56 to 58, further comprising a handle connected to said cam member.

62. A yarn covering apparatus as set forth in any one of claims 54 to 58, in which said restraining means further comprises biasing means urging said plug member to axially move with respect to said sleeve in a direction to move said movable permanent magnet away from said predetermined axial position thereof.

63. A yarn covering apparatus as set forth in claim 2, in which said rotatable member of said first rotor unit is constructed of a non-magnetic material.

* * * * *